United States Patent [19]

Lowry

[11] Patent Number: 4,674,138

[45] Date of Patent: Jun. 23, 1987

[54] DISPOSABLE SITZ BATH

[76] Inventor: Erika R. Lowry, 10610 Fillmore St. NE., Blaine, Minn. 55434

[21] Appl. No.: 726,345

[22] Filed: Sep. 11, 1985

[51] Int. Cl.[4] ..... E03C 1/20; A47K 3/20; A47K 4/00

[52] U.S. Cl. ..... 4/446; 4/420.2; 4/420.3; 4/445; 4/451; 4/452; 4/DIG. 18

[58] Field of Search ..... 4/445-446, 4/420.3, 443, 451, 452

[56] References Cited

U.S. PATENT DOCUMENTS

| | | | |
|---|---|---|---|
| 921,962 | 5/1909 | Jian | 4/445 |
| 1,655,864 | 1/1928 | Haslett | 4/445 |
| 2,251,039 | 7/1941 | Da Silva | 4/445 |
| 3,072,918 | 1/1963 | McCall et al. | 4/445 |
| 3,605,127 | 9/1971 | Dailey | 4/452 |

*Primary Examiner*—Henry K. Artis
*Attorney, Agent, or Firm*—Kinney & Lange

[57] ABSTRACT

A disposable sitz bath for use with a conventional toilet is formed by two sheets of a water impervious, pliable material bonded together on three sides to form a pouch. One corner of the fourth open side of the pouch is excised diagonally to form an overflow drain for the pouch. The sitz bath is designed such that when portions of the pouch adjacent the open side thereof are stretched about the rim of a toilet bowl, it will be retained thereon without the use of fasteners or adhesives. The pouch, when filled with a medicinal fluid, substantially fills the bowl of the toilet, causing the water within the toilet to be automatically flushed. In use, any overflow of fluid from the pouch flows out of the overflow drain and is retained in the toilet.

5 Claims, 6 Drawing Figures

DISPOSABLE SITZ BATH

BACKGROUND OF THE INVENTION

1. Field of the Invention

This invention relates to a disposable sitz bath for use with a conventional toilet.

2. Description of the Prior Art

Sitz baths, or bidets, have commonly been used in connection with perineal hygiene, particularly for feminine hygiene. Sitz baths are often prescribed by doctors as therapy to provide relief from discomfort in the vaginal and rectal areas following incisions made at the time of child birth or rectal surgery. The device may also be used to treat pyogenic infections of the vulvar and/or rectal areas in women and the perirectal and/or scrotal areas in men. In addition to providing relief from discomfort, the sitz bath has been found to promote healing through better maintenance of hygiene in the rectal-genital areas.

Despite the advantages of a sitz bath, such fixtures have not been widely used in this country primarily because early sitz baths were constructed of preformed rigid materials, resulting in a clumsy, relatively bulky device, inconvenient for travel or storage. In addition, such devices were relatively expensive and had to be disinfected and cleaned between each use.

U.S. Pat. No. 3,729,748 to Perlman discloses a bowl having upwardly extending flanges to embrace the seat of a toilet. The Perlman sitz bath is constructed of a rigid plastic (polyethylene), making the device relatively bulky and unhandy. In addition to being difficult to clean and disinfect, drainage of the Perlman device can be strenuous if the person using the sitz bath is infirmed, as the bath must be lifted and tipped for drainage.

Numerous rigid plastic sitz baths have been disclosed, including U.S. Pat. No. 3,490,079 to Stolbach, U.S. Pat. No. 3,484,872 to Romberger et al., and U.S. Pat. No. 2,426,303 to Graber. Each of these devices utilizes a rigid bowl or basin which mounts on top of a conventional toilet. In addition to the problems discussed above, the volume of devices of this type is restricted in that the bowl or basin must remain above the water level of the toilet in order to prevent the relatively cold water in the toilet from cooling the warm water within the sitz bath.

Contemporary sitz baths have addressed the problems encountered with the previous devices by using a thin plastic film which is disposable after use as well as being lightweight. For example, U.S. Pat. No. 3,916,452 to Alt discloses a disposable, sanitary, collapsible bidet formed by a plastic envelope which slides over and around a toilet seat. Two walls of the envelope sag into the hole in the seat to form a two-ply liquid receptacle which is supported by the toilet seat. The Alt sitz bath does not provide for an overflow drain which is necessary to prevent water from the sitz bath from running onto the floor. An additional difficulty posed by the Alt sitz bath is the insufficient size of the liquid receptacle. As the Alt device is disposed entirely within the toilet seat, it is difficult to achieve sufficient submersion of the rectal-genital region to realize the entire benefit of a sitz bath.

U.S. Pat. No. 4,025,966 to Rubin discloses a portable and collapsible sitz bath receptacle constructed of a substantially rigid ring enclosed within an envelope of a plastic material. The rigid ring is designed to rest on top of the toilet bowl such that the envelope surrounding it can be pushed through the ring into the toilet bowl, thus forming a liquid receptacle for use as a sitz bath. In addition to a lack of an overflow drain and a relatively small volume liquid receptacle, the Rubin sitz bath is not economical in that the rigid ring is relatively expensive to produce in comparison to the plastic envelope. It is desirable to have a wholly disposable sitz bath which provides a sufficient volume to entirely submerge the rectal-genital region of the person using the device while being economical to produce.

U.S. Pat. No. 4,324,008 to Carr discloses a disposable sitz bath constructed of a flexible membrane which is designed to line a conventional toilet bowl. In addition, the Carr device provides for an integral overflow pipe for the discharge of excess fluid from the sitz bath. Adhesive tabs are used to secure the peripheral edges of the sitz bath to the outside of the toilet. The overflow pipe must be constructed of a relatively rigid material in order to remain open under the weight of the fluid within the flexible membrane, substantially increasing the cost of the sitz bath. The use of adhesive tabs also increases the cost of production of the Carr disposable sitz bath.

There is a need for a disposable sitz bath which can be used with a conventional toilet. Such a disposable sitz bath should be economical to produce as well as providing a large volume for complete submersion of the rectal-genital region. In addition, the sitz bath should have an overflow drain in order to prevent liquid from the sitz bath from spilling onto the floor during use.

SUMMARY OF THE INVENTION

The disposable sitz bath according to the present invention comprises two rectangular sheets of a water-impervious, pliable material substantially bonded about three sides thereof to form a pouch. A corner of the pouch adjacent the open side is diagonally excised. The peripheral edges of the pouch are stretched about the rim of a conventional toilet and remain in a secured position without the use of adhesives. When the sitz bath is in place, the excised corner is positioned at the rear of the toilet to form an overflow drain for the device. The pouch, when filled with medicinal liquid, substantially fills the toilet bowl. The sitz bath is entirely retained on the toilet by the tight fit of the pouch over the edges of the toilet. After use, the medicinal liquid in the pouch is drained into the toilet and the sitz bath discarded.

DETAILED DESCRIPTION OF THE PREFERRED EMBODIMENTS

Figure 1:
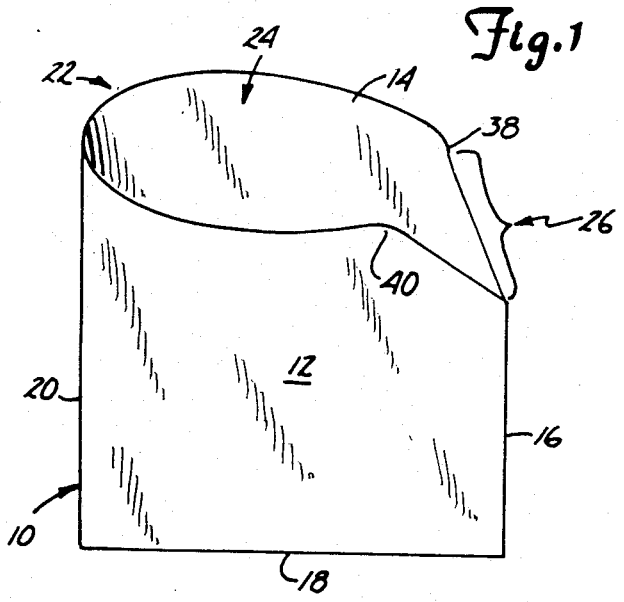
FIG. 1 is an overall plan view of the sitz bath of the present invention.

A disposable sitz bath for use with a conventional toilet is generally indicated at 10 of FIG. 1. The sitz bath 10 is constructed of two substantially rectangular sheets 12, 14 of a water-impervious, pliable material such as, for example, a three mil plastic. The sheets are superimposed and bonded together about three edges thereof (16, 18 and 20) to form a pouch 22. A corner adjacent an open side 24 of the pouch 22 is cut diagonally at a 45° angle to form an excised corner, as indicated at reference character 26. When the sitz bath 10 is installed in the bowl 27 of a conventional toilet 28, as shown in FIG. 2, the excised corner forms an overflow drain for the sitz bath.

The sitz bath 10 is designed to be retained on the rim 29 of bowl 27 of the toilet 28 without the use of adhesives or other fasteners. The dimensions of the sitz bath 10 are predetermined according to the size of the conventional toilet bowl 27 such that the sitz bath 10 is secured to the toilet 28 when the peripheral edges of the pouch are stretched tightly over the rim 29 of the toilet bowl 27. In one preferred embodiment, the sitz bath 10 is dimensioned such that the rectangular sheets 12,14 of the disposable sitz bath are twenty inches in length and twenty-one inches in width, with the open side 24 of the pouch 22 being characterized as a width (from edge 16 to edge 20). The excised corner (26) in this preferred embodiment would have a diagonal length of approximately 10 inches.

Figure 2:
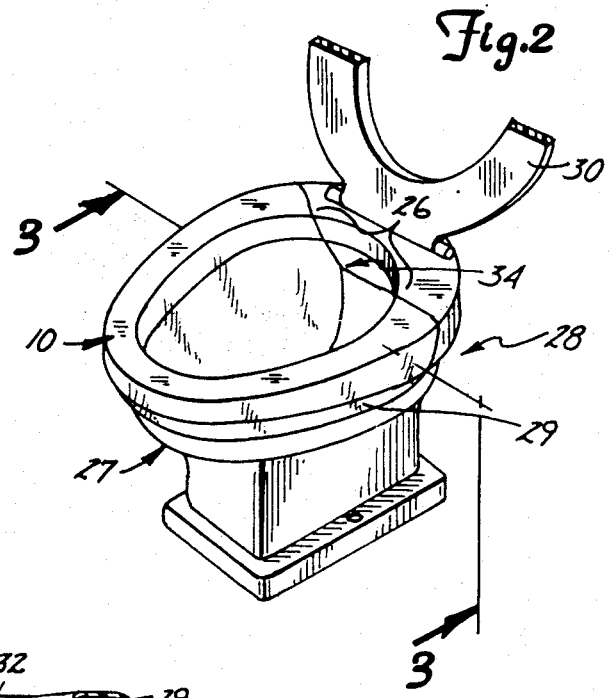
FIG. 2 is a perspective view of the sitz bath of the present invention in place in the bowl of a conventional toilet.
Figure 3:
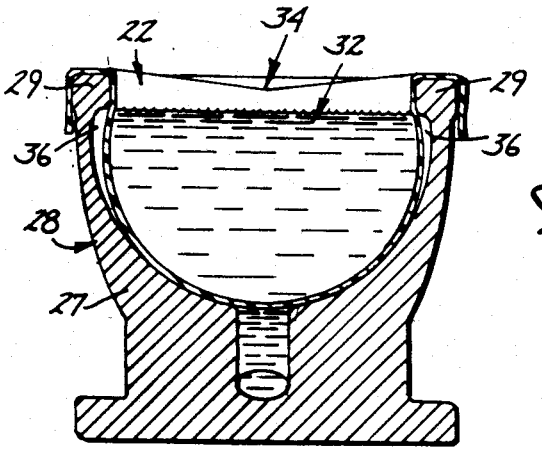
FIG. 3 is a sectional view as taken on line 3—3 in FIG. 2.

The sitz bath 10 is installed with the seat 30 of the toilet in a fully raised positioned away from the toilet bowl 27, as seen in FIG. 2. Once the sitz bath 10 is secured about the rim 29 of the toilet bowl 27, medicinal fluid 32 is introduced to the pouch 22, causing the water within the toilet bowl 27 of the conventional toilet 28 to be automatically flushed. This allows the pouch 22 to conform to the shape of the toilet bowl 27 and be substantially supported by the interior surface of the toilet bowl 27, as seen in FIG. 3.

As shown in FIG. 2, the excised corner (26) of the pouch 22 forms an overflow drain 34 when the sitz bath 10 is installed in a conventional toilet 28. The sitz bath 10 is preferably used with the seat 30 of the toilet 28 in its raised position (see FIG. 2). In this way, a person can sit on the rim 29 of the toilet bowl 27 and expose more of the person's perineal area to the medicinal fluid in the sitz bath 10. When a person settles into the sitz bath 10, excess fluid within the sitz bath 10 flows out of the pouch 22 into the toilet bowl 27 via the overflow drain 34. Fluid drained from the pouch 22 is accumulated in a gap 36 between the pouch 22 and the interior of the toilet bowl 27 which is formed near the rim 29 of the toilet bowl 27, as shown in FIG. 3. The overflow fluid is retained within the gap 36 due to the hydrostatic pressure of the medicinal fluid which forces the walls of the pouch 22 against the interior of the toilet bowl 27.

Installation of the disposable sitz bath 10 of the present invention (which is sterilized and provided to the end user in sterile packaging) within a conventional toilet 28 is a relatively simple process. The user opens the pouch 22 of the disposable sitz bath 10 at points 38 and 40 adjacent the excised corner (26). These points 38 and 40 are then stretched over opposite sides of the rear of the rim 29 of the toilet bowl 27 such that the excised corner forms the overflow drain 34 adjacent the rear of the toilet 28, as shown in FIG. 2. The remaining portions of the open side 24 of the pouch 22 are then stretched over the remainder of the rim 29 of the toilet bowl 27 such that the pouch 22 is firmly retained on the rim 29 of the toilet bowl 27 without the use of adhesives or any other fastening means. The pouch 22 is then filled with a medicinal liquid, causing the water in the toilet 28 to be automatically flushed. The hydrostatic pressure of the medicinal fluid within the pouch 22 causes the toilet 28 to remain in a flushed condition, permitting the pouch 22 of the sitz bath 10 to substantially fill the toilet bowl 27. This also prevents contact between the medicinal fluid (which is usually relatively warm) and the cold water that was in the toilet bowl 27. The sitz bath of the present invention is thus an easy to use, safe and sterile means for providing a sitz bath for home or travel use. Because of its simple construction, the sitz bath 10 of the present invention is quite inexpensive and, therefore, disposable.

Following use of the sitz bath 10 of the present invention, the medicinal fluid in the pouch 22 is emptied into the toilet bowl 27. This is done by pulling upwardly on the pouch 22 opposite its excised corner (26) to force the medicinal fluid to flow out of the pouch 22 and over the overflow drain area 34 into the toilet bowl 27. Alternatively, the pouch 22 may be ruptured by poking a hole through the bottom or sides thereof. Any conventional device having a sufficient length and sufficiently sharp point may be used for this purpose. In either event, the used sitz bath 10 is then lifted from the toilet bowl 27, permitting the medicinal fluid within the pouch 22 to drain into the toilet bowl 27. When drainage is complete, the sitz bath 10 can be discarded and the medicinal fluid is flushed from the toilet 28 in the conventional manner (in most conventional toilets, the accumulation of medicinal fluid in the toilet bowl 27 will cause the toilet 28 to flush itself automatically).

Although the present invention has been described with reference to preferred embodiments, workers skilled in the art will recognize that changes may be made in form and detail without departing from the spirit and scope of the invention.

What is claimed is:

1. A disposable sitz bath for use with a conventional toilet comprises a pair of substantially rectangular sheets of a fluid-impervious, pliable material, said sheets being superimposed and substantially bonded together about three sides thereof to form a pouch having an open side for reception of medicinal fluid, a corner of said pouch adjacent said open side being excised diagonally, and said sitz bath having a size such that edge portions of the pouch adjacent the open side thereof are adapted to stretch about and tightly engage a rim of a bowl of said toilet to support said pouch in position to be fitted with medicinal fluid and in position for use; and of size such that the existing water in the bowl is automatically flushed thereform and substantially replaced in volume by the medicinal fluid retained in the pouch, with said excised corner of the pouch forming an overflow drain into the bowl for the medicinal fluid retained in the pouch.

2. The disposable sitz bath according to claim 1 wherein said rectangular sheets have a length of 20 inches and a width of 21 inches, said excised corner has a diagonal length of 10 inches, and said open side constitutes a width of said rectangular sheets.

3. A method for transforming a conventional toilet into a sitz bath when a seat of said toilet is entirely raised by using a disposable sitz bath of the type which has a pair of substantially rectangular sheets of fluid-impervious, pliable material superimposed and substantially bonded together about three sides thereof to form a pouch with the pouch having an open side for reception of medicinal fluid and a corner thereof being excised diagonally, said method including the steps of:

opening the pouch of said disposable sitz bath by separating the sheets of material at opposite points adjacent the excised corner thereof;

stretching the opposite points adjacent said excised corner across the rear of the bowl of said toilet such that the peripheral edges of said open side of the pouch extend slightly over the rim of said toilet bowl;

stretching portions of the pouch adjacent the remainder of the open side thereof about the remainder of the rim of said toilet bowl such that said disposable sitz bath substantially covers and tightly engages the rim of said toilet bowl and substantially fills the toilet bowl with said excised corner forming an overflow drain for the pouch adjacent the rear of the toilet bowl;

filling the pouch of said disposable sitz bath with a medicinal fluid such that the water in the toilet bowl is automatically flushed therefrom and substantially replaced in volume by the medicinal fluid retained in the pouch of the disposable sitz bath; and collecting any overflow of medicinal fluid from the pouch via the overflow drain into the toilet bowl.

4. The method of claim 3, and further comprising:

seating a patient directly on the rim of the toilet bowl to bathe portions of the patient's pelvic area in the medicinal fluid retained in the pouch.

5. The method of claim 3, and further comprising:

disposing of the medicinal fluid in the pouch, after use, by permitting the medicinal fluid therein to drain into the toilet bowl;

flushing the toilet to dispose of the used medicinal fluid; and discarding the used, disposable sitz bath.

* * * * *

UNITED STATES PATENT AND TRADEMARK OFFICE

CERTIFICATE OF CORRECTION

PATENT NO. : 4,674,138

DATED : June 23, 1987

INVENTOR(S) : Erika R. Lowry

It is certified that error appears in the above-identified patent and that said Letters Patent is hereby corrected as shown below:

Column 4, line 47, delete "thereform" and insert --therefrom--.

Signed and Sealed this

Twenty-seventh Day of October, 1987

*Attest:*

DONALD J. QUIGG

*Attesting Officer*

*Commissioner of Patents and Trademarks*